US005156476A

United States Patent [19]

Ishihara et al.

[11] Patent Number: 5,156,476

[45] Date of Patent: Oct. 20, 1992

[54] PAPER FEED MECHANISM

[75] Inventors: Koichi Ishihara, Kurume; Takashi Tosa, Tosu, both of Japan

[73] Assignee: Matsushita Electric Industrial Co., Ltd., Osaka, Japan

[21] Appl. No.: 704,252

[22] Filed: May 22, 1991

[30] Foreign Application Priority Data

May 24, 1990 [JP] Japan ..... 2-135033

[51] Int. Cl.[5] ..... B41J 11/26

[52] U.S. Cl. ..... 400/616.2; 226/74

[58] Field of Search ..... 400/616-616.3; 226/74, 75; 352/183

[56] References Cited

U.S. PATENT DOCUMENTS

| | | | |
|---|---|---|---|
| 4,682,904 | 7/1987 | Yoshimura et al. | 226/74 |
| 4,742,946 | 5/1988 | Hamamichi et al. | 400/616.2 |
| 4,804,124 | 2/1989 | Hirth | 400/616.2 |
| 4,828,157 | 5/1989 | Yokoi | 400/616 |
| 4,836,430 | 6/1989 | Unuma et al. | 400/616.2 |
| 4,836,431 | 6/1989 | Hirth | 226/74 |
| 4,952,087 | 8/1990 | Iwata et al. | 400/616.1 |
| 4,989,771 | 2/1991 | Ferguson | 226/74 |

FOREIGN PATENT DOCUMENTS

| | | | |
|---|---|---|---|
| 0074855 | 4/1988 | Japan | 226/74 |
| 0167150 | 6/1989 | Japan | 226/74 |

*Primary Examiner*—Eugene H. Eickholt

*Attorney, Agent, or Firm*—Lowe, Price, LeBlanc & Becker

[57] ABSTRACT

A paper feed mechanism for feeding fan-fold paper into a printer, a typewriter, or the like has a drive roller, an idler roller, and a pin belt trained around the drive and idler rollers and having a series of pins for engaging in perforations of the fan-fold paper. The fan-fold paper is guided by first and second paper holders that are angularly supported on a frame. The first paper roller is of an arcuate shape and extending along an outer periphery of the drive roller. The first paper roller is angularly movably supported on the second paper roller. The second paper roller extends along a straight portion of the pin belt between the drive and idler rollers.

9 Claims, 5 Drawing Sheets

PAPER FEED MECHANISM

BACKGROUND OF THE INVENTION

1. Field of the Invention

The present invention relates to a paper feed mechanism for feeding continuous forms of paper, known as fan-fold paper, on a printer, a typewriter, or the like.

2. Prior Art

Paper feed mechanisms for continuously feeding fan-fold paper in the form of a series of joined papers of paper are generally classified into two categories. The paper feed mechanisms in one of the groups comprise a pin-feed tractor unit having a set of pins for engaging in perforated holes in the paper and pulling the paper across the print head of a printer, a typewriter, or the like. The paper feed mechanisms belonging to the other class comprise a pin-feed tractor unit which is designed to push the paper into the printing position in a printer, a typewriter, or the like.

FIGS. 6 and 7 of the accompanying drawings show one conventional paper feed mechanism, and FIG. 8 illustrates continuous forms of paper, i.e., fan-fold paper. The continuous forms of paper, indicated at 1 in FIG. 8, have a series of perforations 1*a* defined in each of their opposite side edges. In each of FIGS. 6 and 7, the fan-fold paper 1 is held against and travels around a cylindrical platen 2. The perforations 1*a* are engaged by successive pins 12*a* disposed on the outer peripheral surfaces of pin belts 12. The pin belts 12 are trained around a drive roller 13 which is coupled to a motor (not shown) and two idle rollers 14 which are rotatably supported on a frame (not shown). A print head 3 is positioned opposite to the platen 2 with the fan-fold paper 1 therebetween, for printing the fan-fold paper 1 as it is successively fed by the paper feed mechanism. The fan-fold paper 1 is held down against the pin belts 12 by angularly movable paper holders 15, 16 so that it will not disengage from the pins 12*a* during operation of the paper feed mechanism.

The paper feed mechanism shown in FIG. 6 is arranged to pull the fan-fold paper 1 to feed it over the platen 2 across the print head 3. To set the fan-fold paper 1 in position, it is threaded upwardly between the platen 2 and the print head 3, and, while the paper holders 15, 16 are being turned upwardly away from the pin belts 12, the perforated holes 1*a* in the fan-fold paper 1 are aligned with and fitted over the pins 12*a* on the pin belts 12. Then, the paper holders 15 are brought down over the pin belts 12, holding the fan-fold paper 1 against removal. When the pin belts 12 are rotated in the direction indicated by the arrows A by the drive roller 13, the fan-fold paper 1 is pulled by the pin belts 12 in the direction indicated by the arrows B. The fan-fold paper 1 is now fed along so as to travel between the platen 2 and the print head 3.

The paper feed mechanism shown in FIG. 7 is arranged to push the fan-fold paper 1 to feed it under the platen 2 across the print head 3. To set the fan-fold paper 1 in position, the paper holders 15, 16 are turned upwardly away from the pin belts 12, and the perforations 12*a* are aligned with and fitted over the pins 12*a*. The paper holders 15, 16 are then turned down over pin belts 12, holding the fan-fold paper 1 against removal. The fan-fold paper 1 is taken under the platen 2 and then guided upwardly between the platen 2 and the print head 3. When the pin belts 12 are rotated in the direction indicated by the arrows C by the drive roller 13, the fan-fold paper 1 is pushed by the pin belts 12 in the direction indicated by the arrows D. The fan-fold paper 1 is now fed along so as to travel between the platen 2 and the print head 3.

With the conventional structures shown in FIGS. 6 and 7, however, since the three rollers 13, 14 are used to drive and support the pin belts 12, the pin belts 12 are relatively long. Therefore, the pin belts 12 tend to elongate, sag, and vibrate. The vibration of the pint belts 12 causes the fan-fold paper 1 to move over back and forth. When the fan-fold paper 1 moves over during printing operation, any letters, numerals, or images are printed on the fan-fold paper 1 by the print head 3 with low quality.

SUMMARY OF THE INVENTION

It is an object of the present invention to provide a paper feed mechanism for feeding fan-fold paper, the paper feed mechanism having relatively short pin belts that are prevented from sagging and vibrating, thereby allowing a print head to print the fan-fold paper with high quality.

A paper feed mechanism for feeding fan-fold paper with perforations into a printer, a typewriter, or the like includes first and second rollers spaced from each other, one of said first and second rollers being drivable to rotate about its own axis, said first and second rollers having different diameters, a pin belt trained around said first and second rollers, said pin belt having a series of pins for engaging in the perforations of the fan-fold paper, said pin belt having a straight portion extending between said first and second rollers, a first paper holder for holding and guiding the fan-fold paper along said pin belt, said first paper holder extending along an outer periphery of one of said first and second rollers which is larger in diameter, and a second paper holder for holding and guiding the fan-fold paper along said pin belt, said second paper holder extending along said straight portion of the pin belt.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENT

Figure 1:
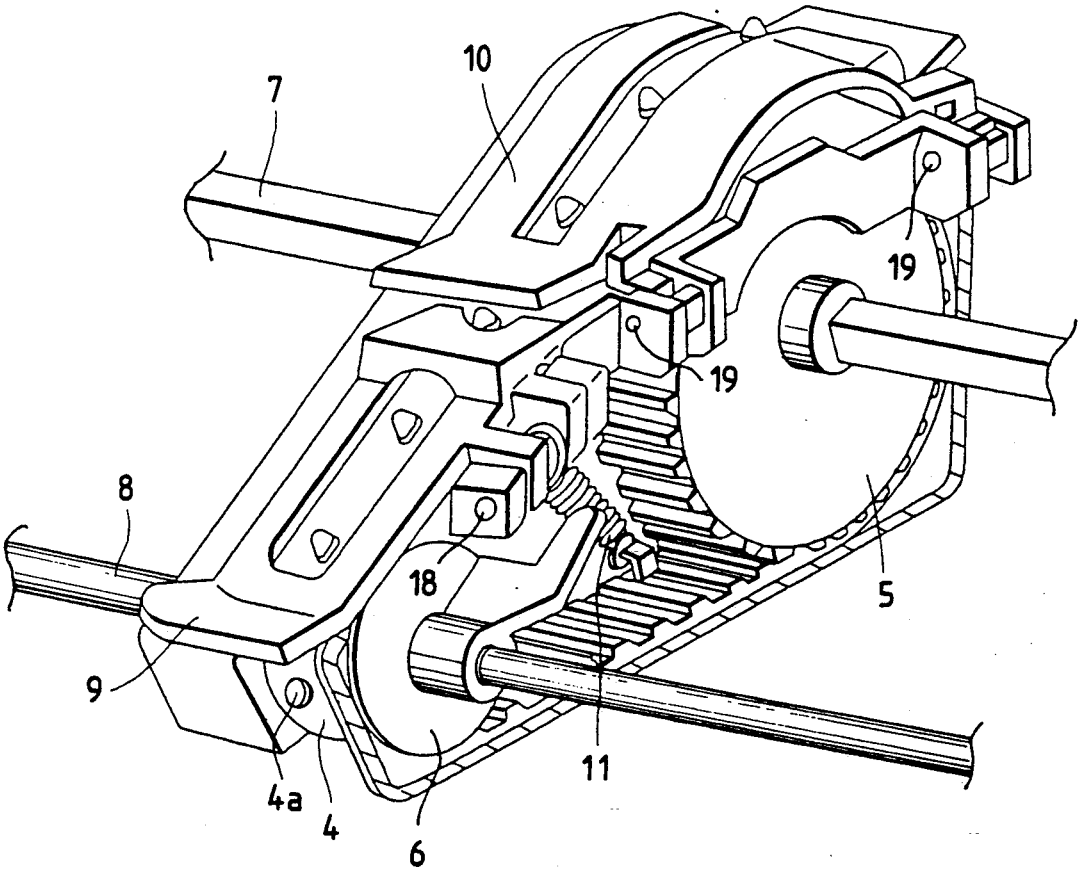
FIG. 1 is a perspective view of a paper feed mechanism according to the present invention.

FIG. 1 shows a paper feed mechanism according to the present invention. The paper feed mechanism is used to feed continuous forms of paper, known as fan-fold paper, designated by the reference numeral 1 in FIGS. 2 and 3. While only one paper feed mechanism is shown in FIG. 1, there are actually two identical paper feed mechanisms which engage opposite side edges of the fan-fold paper to feed the same.

Figure 6:
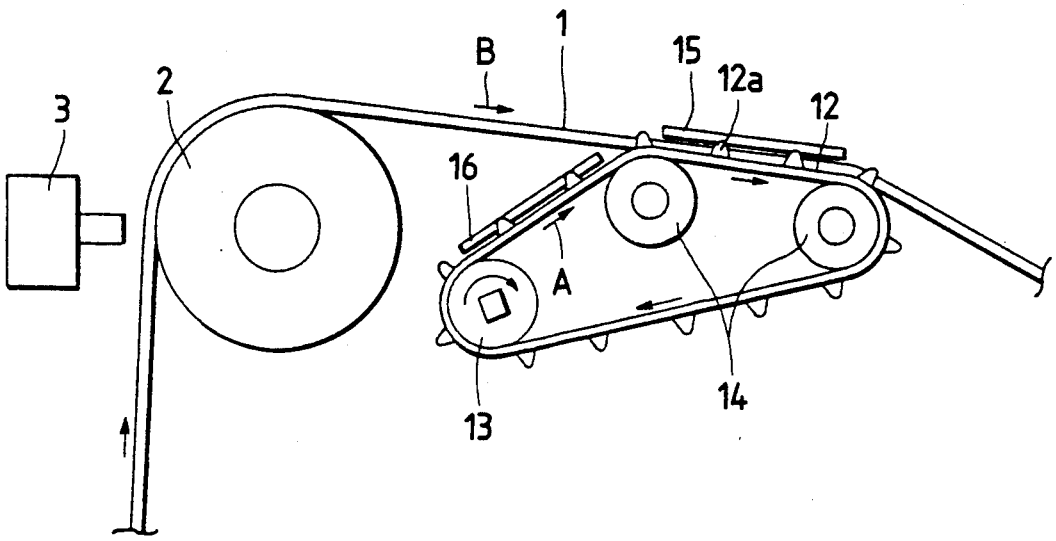
FIG. 6 PRIOR ART
FIGS. 6 and 7 are schematic side elevational views of printers each incorporating a conventional paper feed mechanism.
Figure 7:
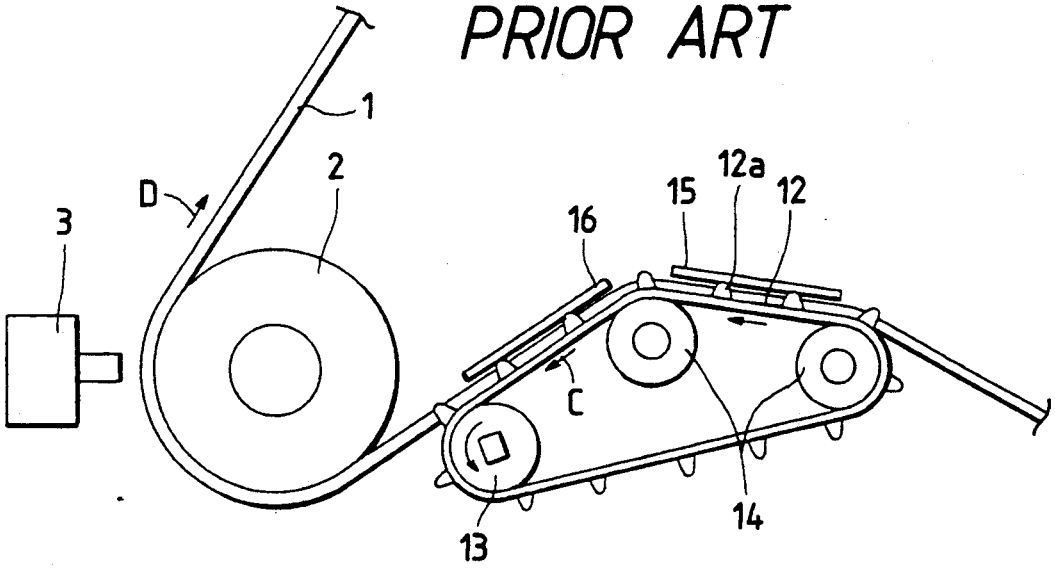
FIG. 7 PRIOR ART
Figure 8:
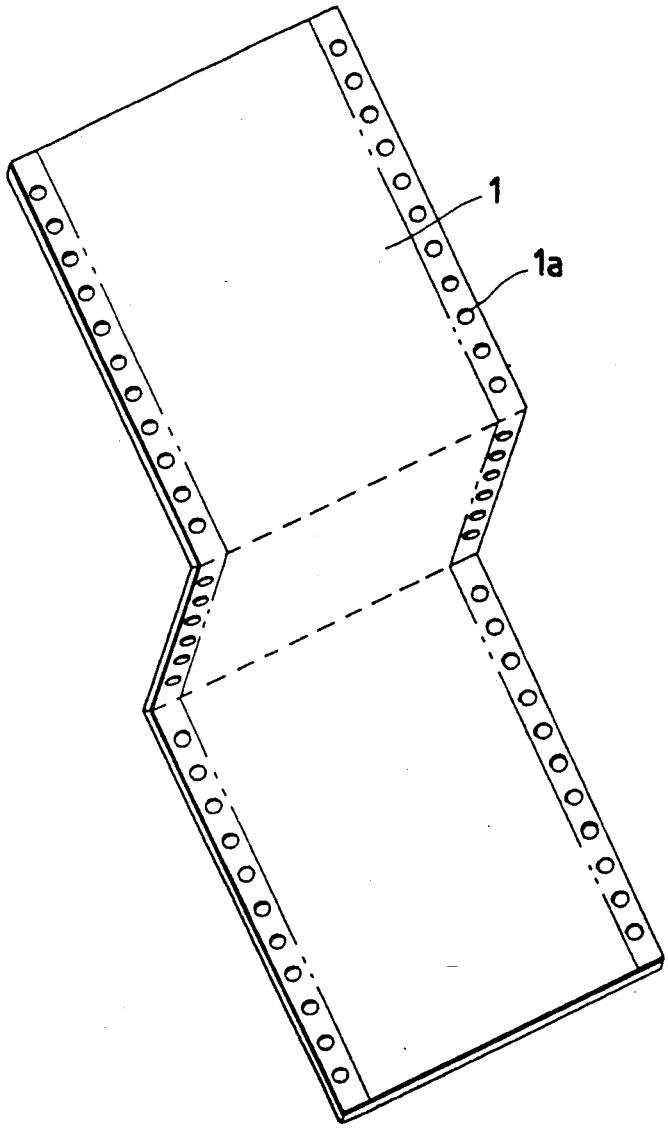
FIG. 8 is a perspective view of continuous forms of paper, i.e., fan-fold paper.

The fan-fold paper 1 has a succession of equally spaced perforated holes 1*a* (FIGS. 2 and 3) defined in each of the opposite side edges thereof. While the fan-fold paper 1 is fed in a printer, a typewriter, or the like by the paper feed mechanism, it travels around a cylindrical platen 2 and between the cylindrical platen 2 and a print head 3 that is positioned opposite to the platen 2 in spaced-apart relationship. The cylindrical platen 2 and the print head 3 are of known nature and may be identical to those shown in FIGS. 6 and 7.

As shown in FIG. 1, the paper feed mechanism has a pin belt 4 having a series of pins 4*a* on its outer peripheral surface at the same interval as the perforations 1*a*. During operation of the paper feed mechanism, the pins 4*a* are inserted successively into and disengage successively from the perforations 1*a*. The pin belt 4 is trained around a drive roller 5 and an idler roller 6 which is smaller in diameter than the drive roller 5. The drive roller 5 is mounted on a drive shaft 7 which is coupled to a motor (not shown). The idler roller 6 is rotatably mounted on a guide shaft 8 that is spaced from and extends parallel to the drive shaft 7, the guide shaft 8 being lower than the shaft 7. The central axis of the idler roller 6, i.e., the guide shaft 8, is positioned below a straight line interconnecting the central axis of the drive roller 5, i.e., the drive shaft 7, and the central axis of the platen 2. The central axis of the idler roller 6 is positioned below a straight line interconnecting the geometrical center of the print head 3 and the central axis of the platen 2, and the central axis of the drive roller 5 is positioned above the same straight line.

Paper holders 9, 10 are angularly movably supported on a frame 17 (see FIGS. 4 and 5) mounted on the shafts 7, 8, the frame 17 being omitted from illustration in FIG. 1.

More specifically, the paper holder 9 is pivotally supported on the frame 17 by a pivot pin 18 parallel to the frame 17, i.e., perpendicularly to the shafts 7, 8. The paper holder 9 can be turned between a lying position (see FIG. 4) in which it lies over the pin belt 4 and a lifted position (see FIG. 5) in which it is angularly displaced away from the pin belt 4. The paper holder 9 is normally biased into the lying position under the resiliency of a spring 11 acting between the frame 17 and the paper holder 9. The paper holder 9 is of a substantially flat shape and extends over a straight portion of the pin belt 4 above the idler roller 6 and between the idler roller 6 and the drive roller 5. The paper holder 10 is angularly movably mounted by pivot pins 19 parallel to the frame 17 on the upper portion of the paper holder 9 which extends over the drive roller 5. The paper holder 10 can be turned with respect to the paper holder 9 between a lying position (see FIG. 1) in which the paper holder 10 is held against the paper holder 9 and a lifted position (see FIG. 4) in which the paper holder 10 is angularly displaced away from the paper holder 9. The paper holder 10 is of an arcuate shape and extends partly around the drive roller 5.

A line extending longitudinally from the paper holder 9 as it is in the lying position is tangential to the outer peripheral surface of the platen 2. The paper holder 10 has an end surface 10*a* which, when the paper holder 10 is in the lying position, guides the fan-fold paper 1 at a common line which is tangential to both the drive roller 5 and the platen 2.

When the paper holder 9 is in the lying position, as shown in FIG. 1, with the fan-fold paper 1 held therebelow, it guides the fan-fold paper 1 along the straight portion of the pin belt 4 between the drive roller 5 and the idler roller 6. When the paper holder 10 is in the lying position as shown in FIG. 1, with the fan-fold paper 1 held therebelow, it guides the fan-fold paper 1 partly around the drive roller 5 along its upper outer peripheral portion.

Operation of the paper feed mechanism according to the present invention will be described below.

Figure 2:
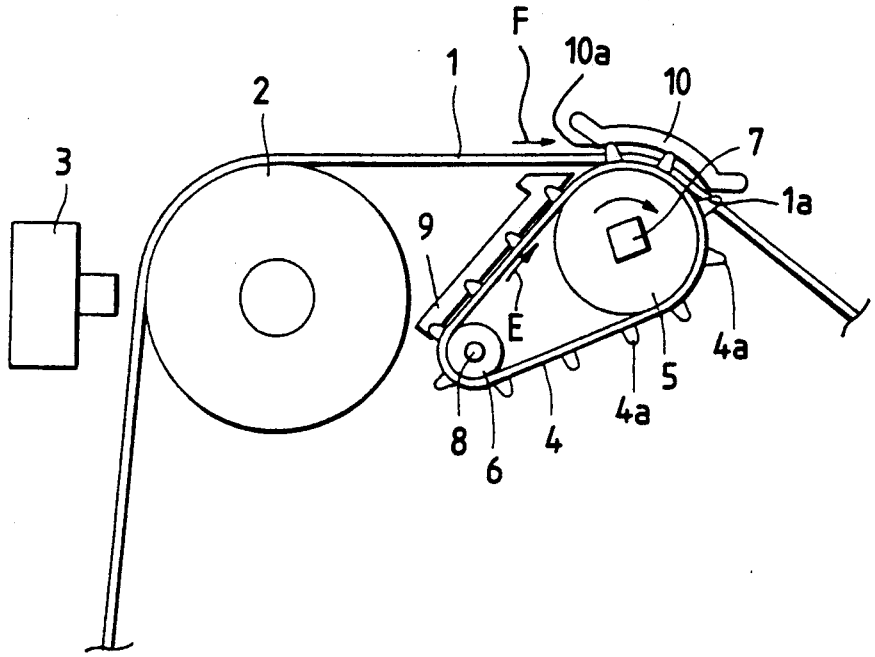
FIGS. 2 and 3 are schematic side elevational views of printers each incorporating the paper feed mechanism shown in FIG. 1.
Figure 4:
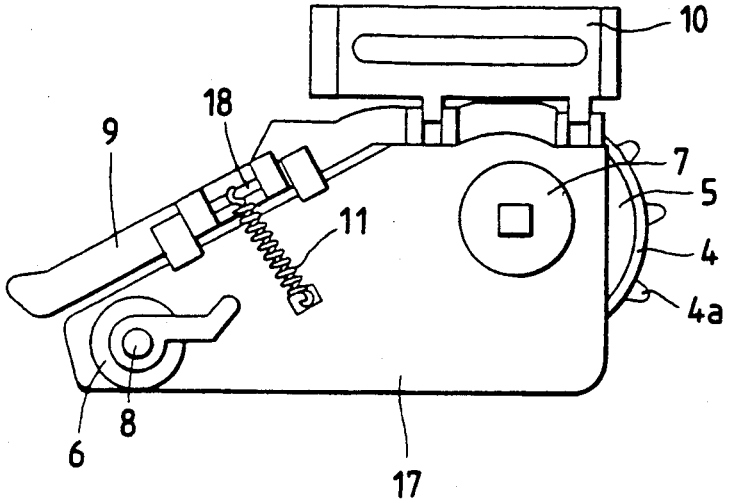
FIGS. 4 and 5 are side elevational views of the paper feed mechanism, showing paper holders opened in different modes.

FIGS. 2 and 4 show the paper feed mechanism as it is arranged to pull the fan-fold paper 1 into the printer, for example, to feed the same continuously. First, the fan-fold paper 1 is threaded between the platen 2 and the print head 3, and the paper holder 10 is turned upwardly into the lifted position away from the paper holder 9, as shown in FIG. 4. The perforations 1*a* in the fan-fold paper 1 are aligned with and fitted over those pins 4*a* which are positioned along the upper outer periphery of the drive roller 5. Thereafter, the paper holder 10 is turned downwardly into the lying position against the paper holder 9, thereby holding the fan-fold paper 1 down against the pin belt 4 as shown in FIG. 2. The fan-fold paper 1 is now securely retained in the paper feed mechanism against dislodgement therefrom. Now, the drive roller 5 is rotated by the drive shaft 7 to rotate the pin belt 4 in the direction indicated by the arrow E (FIG. 2). The fan-fold paper 1 is pulled by the pins 4*a* of the pin belt 4, moving in the direction indicated by the arrow F while passing between the platen 2 and the print head 3.

Figure 3:
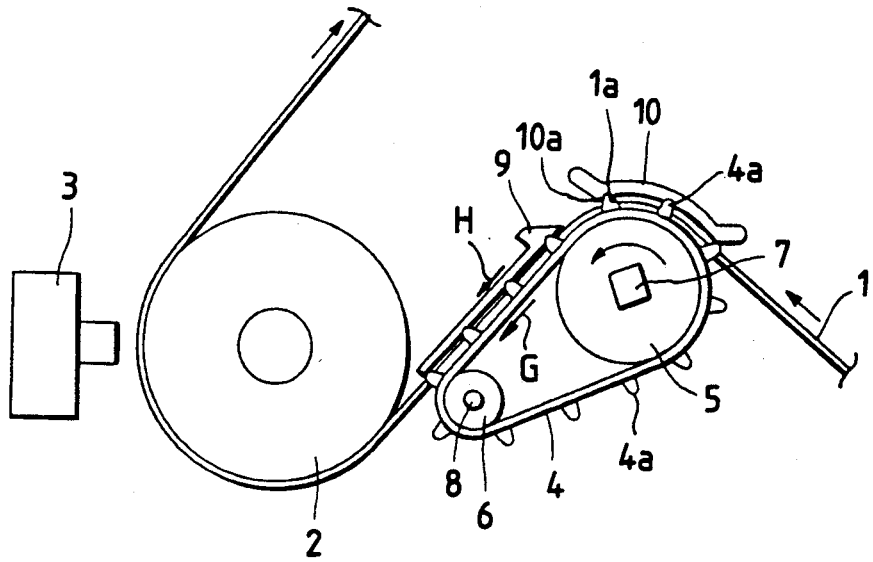
Figure 5:
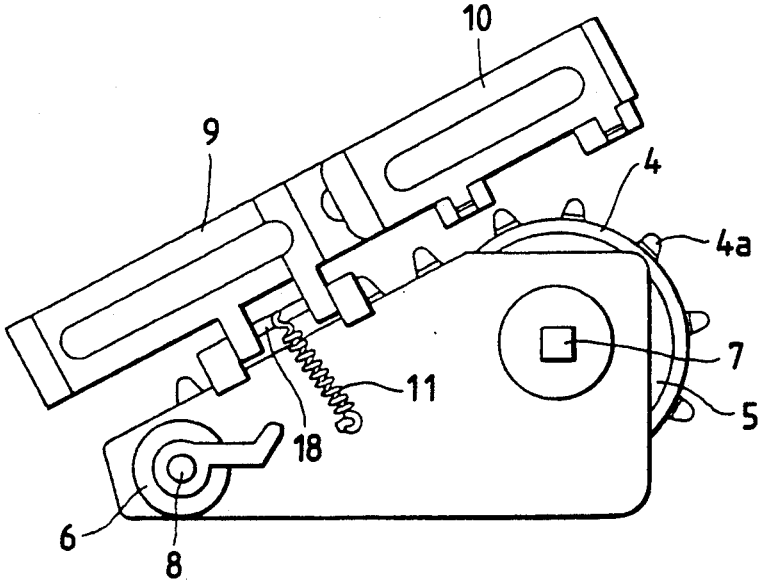

FIGS. 3 and 5 show the paper feed mechanism as it is arranged to push the fan-fold paper 1 into the printer, for example, to feed the same continuously. First, the paper holder 9 and hence the paper holder 10 supported thereon are brought into the lifted position away from the pin belt 4, as illustrated in FIG. 5. The perforated holes 1*a* in the fan-fold paper 1 are aligned with and fitted over those pins 4*a* which are positioned along the upper outer periphery of the drive roller 5 and the upper straight portion of the pin belt 4. Then, the paper holders 9, 10 are turned downwardly into the lying position to hold the fan-fold paper 1 down against the pin belt 4 so that the fan-fold paper 1 will not be dislodged from the paper feed mechanism. The drive roller 5 is rotated by the drive shaft 7 to rotate the pin belt 4 in the direction indicated by the arrow G (FIG. 3). The fan-fold paper 1 is pushed by the pins 4*a* of the pin belt 4, moving in the direction indicated by the arrow H while passing between the platen 2 and the print head 3.

The paper feed mechanism according to the illustrated embodiment employs only two rollers, i.e., the drive roller 5 and the idler roller 6. Therefore, the pin belt 4 trained around these rollers may be shorter than the pin belt trained around the three rollers of the conventional paper feed mechanism. The pin belt 4 is thus subject to less elongation, sagging, vibration, and unwanted lateral movement. Accordingly, the fan-fold paper 1 fed by the paper feed mechanism can be printed with high quality.

Although a certain preferred embodiment has been shown and described, it should be understood that many changes and modifications may be made therein without departing from the scope of the appended claims.

We claim as our inventions:

1. A paper feed mechanism for feeding fan-fold paper with perforations, comprising:

first and second rollers spaced from each other, one of said first and second rollers being drivable to rotate about its own axis, said first and second rollers having different diameters;

a pin belt trained around only said first and second rollers, said pin belt having a series of pins for engaging in the perforations of the fan-fold paper, said pin belt having a straight portion extending between said first and second rollers;

a first paper holder for holding and guiding the fan-fold paper along said pin belt, said first paper holder extending along an outer periphery of one of said first and second rollers which is larger in diameter;

a second paper holder for holding and guiding the fan-fold paper along said pin belt, said second paper holder extending along said straight portion of the pin belt; and a platen for guiding the fan-fold paper to travel there-around, the other of said first and second rollers which is smaller in diameter being positioned more closely to said platen than said one of the first and second rollers.

2. A paper feed mechanism for feeding fan-fold paper with perforations, comprising:

first and second rollers spaced from each other, one of said first and second rollers being drivable to rotate about its own axis, said first and second rollers having different diameters;

a pin belt trained around said first and second rollers, said pin belt having a series of pins for engaging in the perforations of the fan-fold paper, said pin belt having a straight portion extending between said first and second rollers;

a first paper holder for holding and guiding the fan-fold paper along said pin belt, said first paper holder extending along an outer periphery of one of said first and second rollers which is larger in diameter; and a second paper holder for holding and guiding the fan-fold paper along said pin belt, said second paper holder extending along said straight portion of the pin belt, wherein said first paper holder is angularly movably supported on said second paper holder by a pivot pin.

3. A paper feed mechanism according to claim 1, further including a drive shaft and a guide shaft spaced from and extending parallel to said drive shaft, the drivable one of the first and second rollers being fixedly mounted on said drive shaft, the other of the first and second rollers being rotatably mounted on said guide shaft, and a frame mounted on said drive and guide shafts, said second paper holder being angularly movably supported on said frame by a pivot pin.

4. A paper feed mechanism according to claim 1, further including a platen spaced from and disposed adjacent to said pin belt, the smaller-diameter one of the first and second rollers being positioned below a line interconnecting the center of the larger-diameter one of the first and second rollers and the center of said platen.

5. A paper feed mechanism according to claim 1, further including a platen positioned such that a line extending from said second paper holder is tangential to an outer periphery of the platen.

6. A paper feed mechanism for feeding fan-fold paper with perforations, comprising:

first and second rollers spaced from each other, one of said first and second rollers being drivable to rotate about its own axis, said first and second rollers having different diameters;

a pin belt trained around said first and second rollers, said pin belt having a series of pins for engaging in the perforations of the fan-fold paper, said pin belt having a straight portion extending between said first and second rollers;

a first paper holder for holding and guiding the fan-fold paper along said pin belt, said first paper holder extending along an outer periphery of one of said first and second rollers which is larger in diameter;

a second paper holder for holding and guiding the fan-fold paper along said pin belt, said second paper holder extending along said straight portion of the pin belt; and a platen positioned such that a line extending from said second paper holder is tangential to an outer periphery of the platen, wherein said first paper holder has an end surface for guiding the fan-fold paper at a common line tangential to both said platen and the larger-diameter one of the first and second rollers.

7. A paper feed mechanism for feeding fan-fold paper with perforations, comprising:

a platen for guiding the fan-fold paper there-around;

a first roller rotatable about a first axis parallel to said platen;

a second roller rotatable about a second axis parallel to said platen, said second roller being spaced from and greater in diameter than said first roller and positioned more remotely from said platen than said first roller;

a pin belt trained around said first and second rollers, said pin belt having a series of equally-spaced pins for engaging in the perforations of the fan-fold paper;

a print head for printing the fan-fold paper, said print head being disposed opposite to said platen in spaced-apart relationship thereto;

a first paper holder for guiding the fan-fold paper, which either has been printed or is to be printed by said print head, along an outer periphery of said second roller; and a second paper holder for guiding the fan-fold paper, which is to be printed by said print head, along a portion of said pin belt which extends from said second roller toward said first roller.

8. A paper feed mechanism for feeding fan-fold paper with perforations, comprising:

a platen for guiding the fan-fold paper there-around;

a first roller rotatable about a first axis parallel to said platen;

a second roller rotatable about a second axis parallel to said platen, said second roller being spaced from and greater in diameter than said first roller;

a pin belt trained around said first and second rollers, said pin belt having a series of equally-spaced pins for engaging in the perforations of the fan-fold paper;

a print head for printing the fan-fold paper, said print head being disposed opposite to said platen in spaced-apart relationship thereto;

a first paper holder for guiding the fan-fold paper, which is to be printed by said print head, along a portion of said pin belt which extends from said second roller toward said first roller, wherein said first paper holder is mounted on said second paper holder.

9. A paper feed mechanism for feeding fan-fold paper with perforations, comprising:

a platen for guiding the fan-fold paper there-around;

a first roller rotatable about a first axis parallel to said platen;

a second roller rotatable about a second axis parallel to said platen, said second roller being spaced from and greater in diameter than said first roller;

a pin belt trained around said first and second rollers, said pin belt having a series of equally-spaced pins for engaging in the perforations of the fan-fold paper;

a print head for printing the fan-fold paper, said print head being disposed opposite to said platen in spaced-apart relationship thereto;

a first paper holder for guiding the fan-fold paper, which either has been printed or is to be printed by said print head, along an outer periphery of said second roller; and a second paper holder for guiding the fan-fold paper, which is to be printed by said print head, along a portion of said pin belt which extends from said second roller toward said first roller, wherein said first paper holder is mounted on said second paper holder, and wherein said first axis is positioned below a line interconnecting the center of said print head and the center of said platen, and said second axis is positioned above said line.

* * * * *